US006385932B1

(12) United States Patent
Melchiori

(10) Patent No.: US 6,385,932 B1
(45) Date of Patent: May 14, 2002

(54) STREAMLINED WEEP SCREED

(76) Inventor: Ugo L. Melchiori, 1116 Crestline Dr., Santa Barbara, CA (US) 93105

( * ) Notice: Subject to any disclaimer, the term of this patent is extended or adjusted under 35 U.S.C. 154(b) by 0 days.

(21) Appl. No.: 09/771,502

(22) Filed: Jan. 26, 2001

(51) Int. Cl.[7] ..... E04B 1/64

(52) U.S. Cl. ..... 52/302.3; 52/302.6; 52/62; 52/310; 52/371; 52/720.1

(58) Field of Search ..... 52/302.3, 302.6, 52/62, 61, 97, 169.5, 370, 371, 101, 720.1, 730.1, 730.6, 733.2

(56) References Cited

U.S. PATENT DOCUMENTS

| | | | | | |
|---|---|---|---|---|---|
| 1,029,106 | A | * | 6/1912 | Collins | 52/371 |
| 1,624,121 | A | * | 4/1927 | Thiem | 52/371 |
| 3,343,323 | A | * | 9/1967 | Mayfield | 52/302.3 |
| 5,630,297 | A | * | 5/1997 | Rutherford | 52/58 |
| 5,979,123 | A | * | 11/1999 | Brockman | 52/101 |
| 6,052,959 | A | * | 4/2000 | LaBrosse | 52/302.6 |
| 6,293,064 | B1 | * | 9/2001 | Larson | 52/302.1 |
| 6,298,609 | B1 | * | 10/2001 | Bifano et al. | 52/58 |

* cited by examiner

*Primary Examiner*—Carl D. Friedman
*Assistant Examiner*—Brian E. Glessner

(74) *Attorney, Agent, or Firm*—Michael G. Petit

(57) ABSTRACT

A weep screed for use in exterior construction has a vertical member and upper and lower outwardly projecting flanges affixed to the vertical member. The vertical member is adapted to be form-fit to the base of a vertical wall overlying a concrete foundation. The upper outwardly projecting flange is coextensive with the length of the screed and has a plurality of apertures therein, the apertures being spaced from one another along the length of the weep screed to provide drainage for water accumulating on an upper surface of the upper outwardly projecting flange. The lower outwardly projecting flange, which is coextensive in length with the upper outwardly projecting flange, is impermeable to water. The lower flange collects water received from the upper member and directs the flow of such water outwardly, away from the vertical wall and foundation. The weep screed permits the placement of plaster, stucco or other siding material to be placed in contact with the weep screed both above and below the outwardly projecting flanges, leaving a streamlined gap therebetween. The weep screed directs water that penetrates a plaster layer of a wall to flow away from the wall above ground level. In addition, the weep screed can provide an expansion joint between a concrete foundation or slab and wood framing. The weep screed can be fabricated from any malleable water-impermeable material.

10 Claims, 2 Drawing Sheets

STREAMLINED WEEP SCREED

BACKGROUND OF THE INVENTION

1. Field of the Invention

The present invention relates to a weep screed, and more particularly, to a member for attachment along the base of a structure to prevent moisture from entering between the structure and a foundation underlying the structure.

2. Prior Art

A weep screed is a device that is attached to the base of an exterior wall of a structure to provide support for an exterior coating such as, for example, stucco, and to provide a barrier to water entering between the exterior wall and the underlying foundation of the structure. In the prior art, the weep screed has a vertical attachment member, an outwardly protruding flange that is attached to a lower edge of the vertical member and angled downwardly. The outwardly protruding member is recurved at the outermost end thereof and bends downwardly and rearwardly toward the concrete foundation. A third member may extend downwardly from the lower end of the recurved member. The vertical member may assist in supporting the exterior coating surface. Water which comes into contact with the exterior coating surface may be absorbed into the surface and possibly also into the building layers underneath the surface. The water can drain downwardly and weep from the structure along the edge of the weep screed. Weep screeds are intended to reduce moisture absorption, particularly in areas where water is permitted to accumulate near the edge of the structure.

U.S. Pat. No. 5,630,297 to Rutherford, the teaching of which is incorporated herein by reference thereto, discloses a weep screed for use in exterior construction. The weep screed has a vertical member and an outwardly projecting member, the outermost end of which is recurved downwardly and inwardly to provide sealing means operable for forming a substantially sealing engagement with the vertical outer surface of an underlying concrete foundation. The inwardly projecting member has a plurality of grooves or notches running along the length of the weep screed to provide tear strips. The tear strips permit adjustability of the length of the inwardly projecting member by allowing it to be torn off, or to permit bending of the inwardly projecting member for a form fit with the foundation where a flush fit occurs at a point in between tear strips. By eliminating the gap present in the prior art, the present invention diminishes or eliminates any swelling of the shear panel which causes cracking of the exterior surface.

Notwithstanding the advantages of the prior art weep screeds, for architectural reasons, it may be desirable to place a coating on the foundation or other vertical surface below the screed. Prior art screeds permit collected water to drain downwardly through slots in the recurved member thereby compromising the integrity of a layer of coating disposed below the screed. There remains a need for a weep screed that enables a layer of coating material to be disposed below and abutting the weep screed without compromising the structural integrity of the coating material due to water seepage.

SUMMARY

It is a first object of the invention to provide a weep screed that enables a layer of building material to disposed below and in contact with the screed without compromising the structural integrity of such a layer of such building material.

It is a further object of the invention to provide a weep screed meeting the above objective and wherein the weep screed provides a streamlined gap between layers of building material disposed above and below the weep screed.

The present invention provides for an improved weep screed having advantages over the weep screeds set forth in the prior art. The streamlined weep screed provides a means for performing the function provided by current weep screeds, and additionally enables a building material to be placed below, and in contact with, the weep screed, leaving a streamlined gap therebetween that is aesthetically pleasing to the eye.

In accordance with the present invention, a weep screed has a flat vertical member that is adapted to attached to a wall construction material, such as plywood sheathing, tar paper overlying the sheathing or the like, to form a sealing engagement with the wall construction material using fasteners, adhesive or both. An upper flange having perforations therein, depends downwardly and outwardly from a lower portion of the vertical member. The upper flange directs the flow of water in contact with the upper surface thereof, such as moisture accumulated in stucco siding, outwardly (i.e., away from the wall) and downwardly to drip onto a lower flange. The lower flange, which is impermeable to water, also depends outwardly and downwardly from the vertical member and directs the flow of water outwardly to the outermost extent thereof, thereafter to drip to the ground under the force of gravity. The weep screed may be made from a sheet metal such as aluminum, or a flexible elastomer. The weep screed can be made by extrusion, molding or assembled by welding one or both of the flanges to the vertical member.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1:
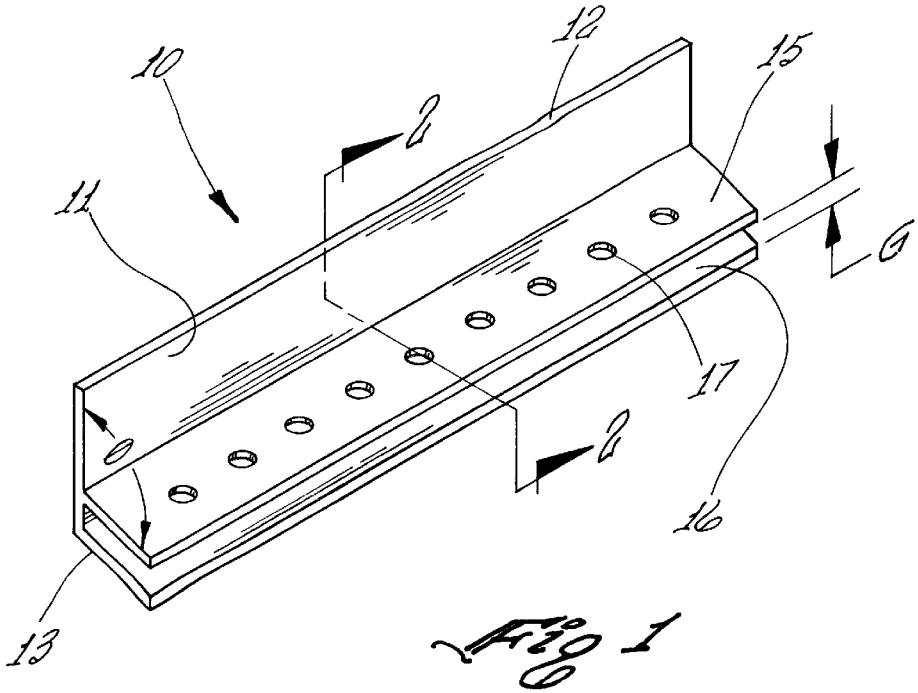
FIG. 1 is a perspective view of a preferred embodiment of a weep screed in accordance with the present invention.
Figure 3:
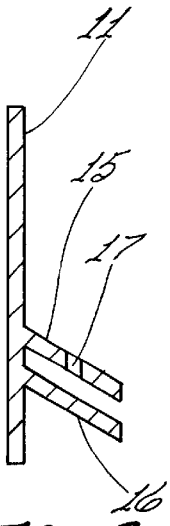
FIG. 3 is a cross-sectional view of a weep screed in accordance with a second preferred embodiment of the present invention wherein the vertical member extends below the upper and lower flanges.

Turning first to FIG. 1, a weep screed in accordance with a first preferred embodiment of the present invention is shown in perspective view at numeral 10. The weep screed 10 includes a somewhat flexible vertical member 11 having an upper edge 12 and a lower edge 13. A rear surface 14 is substantially flat. The weep screed 10 further includes an upper flange 15 and a lower flange 16 attached to the vertical member 11 near the lower edge 13 thereof. The upper flange 15 has a plurality of apertures 17 therein dimensioned to conduct water accumulating above the upper flange to the lower flange 16. The upper and lower flanges extend from the vertical member at an obtuse angle θ.

Figure 2:
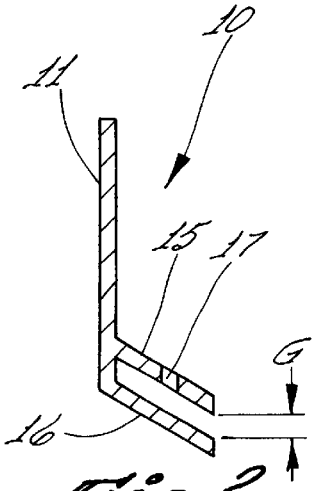
FIG. 2 is a cross-sectional view of a weep screed as illustrated in FIG. 1, taken along section line 2—2.
Figure 4:
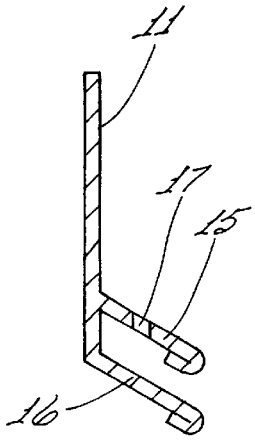
FIG. 4 is across-sectional view of a weep screed in accordance with a third preferred embodiment of the present invention wherein the lower flange is recurved downward at and inwardly at the outermost end thereof.
Figure 5:
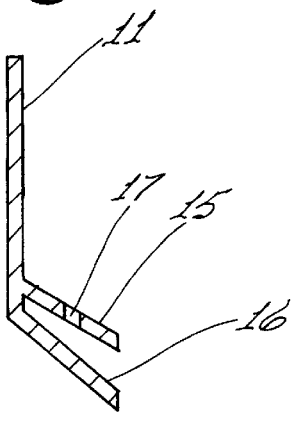
FIG. 5 is a cross-sectional view of a weep screed in accordance with yet a fourth preferred embodiment of the present invention wherein the upper flange and the lower flange are juxtaposed at their juncture with the vertical member.

With reference now to FIGS. 2–5, first, second, third and fourth preferred embodiments of the weep screed are illustrated in cross-sectional view, taken along section line 2—2 of FIG. 1. FIG. 2 is a first preferred embodiment of the weep screed in accordance with the present invention wherein the upper flange 15 and the lower flange 16 are spaced from one another by a gap G along the width thereof. The gap G between the upper and lower flanges is preferable about ⅛ inch wide. Both the upper and lower flanges angle downwardly from the vertical member 11 and may be either parallel to one another or the lower flange can have a greater downward angle than the upper flange with respect to the plane of the vertical member.

Figure 6:
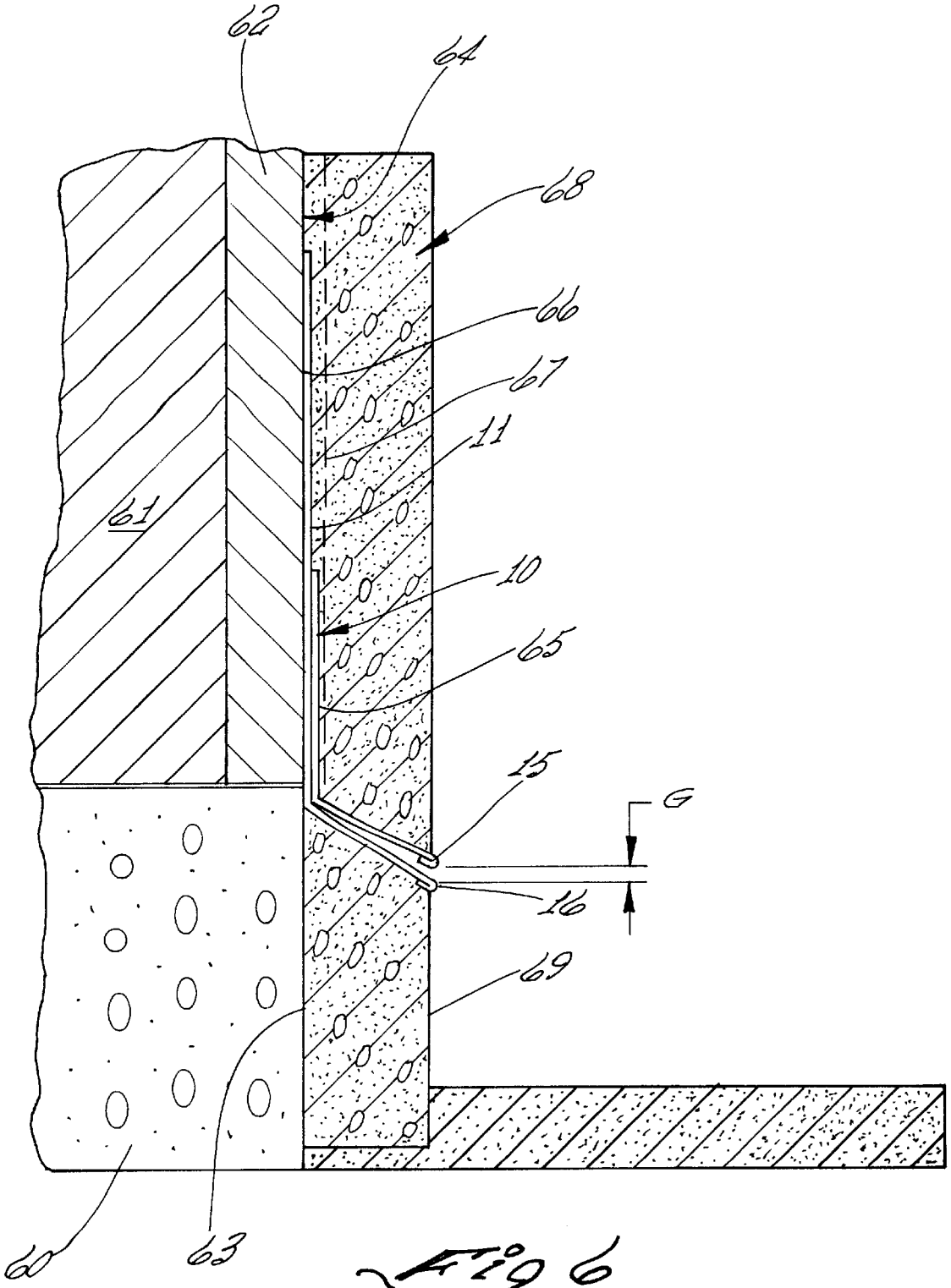
FIG. 6 is a cross-sectional view of a streamlined weep screed in accordance with the present invention, shown in the context of its intended use in the building construction art.

Referring now to FIG. 6, a vertical cross-sectional view shows a concrete foundation slab 60, an exemplary framing member 61 and an exemplary sheathing layer 62, which sheathing layer 62 has an exterior outer surface 64 that is flush with the outer vertical surface 63 of the foundation slab 60. Mounted on the exterior surface 64 of the sheathing layer 62 is yet another welded embodiment of a weep screed 10 made according to the present invention. In the welded embodiment, the vertical member 11 is bent outwardly at the lower edge thereof to form the lower flange 16. A second bent sheet 65 is welded to the vertical member 11 with the bent lower edge of the sheet 65 forming the upper flange 15. Mounted on the outer surface 64 of the sheathing layer 63 and the weep screed 10 is at least one layer of water-impermeable building paper 66 and a layer of wire lath 67 as exemplary of a typical base for an exterior coating.

The weep screed 10 is typically made of sheet metal or a plastic such as exterior grade vinyl which is flexible yet impermeable to air and water. The weep screed 10 can be made in strips either by extrusion, molding or welding. If extrusion is used to make the weep screed, it can be made in any desired length. The weep screed 10 can be made to have either unitary structure or integral structure. The sheet metal or elastomer used to fashion the weep screed preferably has a thickness of about 0.060 inch. The material used to fabricate the weep screed should not be susceptible to rust or other environmental degradation. According to the Universal Building Code, the vertical member 11 is required to have a length of at least 3½ inches.

The weep screed 10 can be made in any length suitable for use on an exterior wall of a structure. Typically, the weep screed 10 will be prefabricated in set lengths and may be cut to fit the structure on which the weep screed is to be applied. Conversely, two or more weep screeds may be used adjoining one another on a side of a structure which is longer than the prefabricated length of the weep screed. The upper flange 11 of the weep screed 10 is designed to support the bottom of an exterior coating 68 such as stucco. Accordingly, the outermost edge of the upper flange may be upwardly curved (not shown) to perform this function.

Again with reference to Figure to FIG. 6, a layer of building material 68 is applied to the exterior surface of the wall above the weep screed in a manner well known in the construction arts. Unlike prior art weep screeds, the present weep screed 10 permits a layer of building material 69 to be applied to coat the wall below the weep screed. The lower coating 69 preferably has an upper boundary that abuts the lower flange 16. The gap G between the upper and lower flanges provides a streamlined margin between the upper coating layer 68 and the lower coating layer 69 along the length of the weep screed 10. Since moisture cannot penetrate the lower flange from above, the structural integrity of lower layer 69 cannot be compromised by seepage of water from above.

The weep screed of the present invention permits the placement of plaster, stucco or other siding material to be placed in contact with the weep screed both above and below the outwardly projecting flanges, leaving a streamlined gap therebetween. The weep screed directs water that penetrates a plaster layer of a wall to flow away from the wall above ground level. In addition, the weep screed can provide an expansion joint between a concrete foundation or slab and wood framing. The weep screed can be fabricated from any malleable water-impermeable material. Not only can the present weep screed serve the same purpose as a foundation sill screed, but it also has the benefit of providing a streamlined appearance which may be regarded as a desirable architectural feature.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A weep screed comprising:

(a) an elongate, substantially planar vertical member having a length, an upper edge, a lower edge and an outer surface;

(b) an upper flange extending outwardly and downwardly from said outer surface of said vertical member at an obtuse angle;

(c) a lower flange extending outwardly and downwardly from said outer surface of said vertical member at an obtuse angle, said lower flange being disposed adjacent to and below said upper flange and being impermeable to water;

(d) a plurality of apertures in said upper flange, said apertures being operable for conducting water therethrough.

2. The weep screed of claim 1 wherein the weep screed is of unitary construction.

3. The weep screed of claim 1 wherein the weep screed is of integral construction.

4. The weep screed of claim 1 wherein said lower flange is attached to said vertical member at the lower edge thereof.

5. The weep screed of claim 1 wherein said lower flange is attached to said outer surface of said vertical member between said lower edge and said upper edge thereof.

6. The weep screed of claim 1 wherein said upper flange has an inner edge that is attached to said outer surface of said vertical member and an outermost edge in opposition to and parallel to said inner edge wherein said outermost edge of said upper flange is recurved upwardly.

7. The weep screed of claim 1 wherein said weep screed is unitary in construction and comprises an extruded metal.

8. The weep screed of claim 1 wherein said weep screed is an extruded elastomeric material.

9. The weep screed of claim 1 wherein said weep screed is a molded unitary structure.

10. The weep screed of claim 1 comprising a welded integral structure.

* * * * *